United States Patent [19]

Labelle

[11] 4,196,824

[45] Apr. 8, 1980

[54] PASTA DISPENSER

[76] Inventor: Roch Labelle, 290 Edouard St., Fabreville, Laval, Quebec, H7P 2M7, Canada

[21] Appl. No.: 8,080

[22] Filed: Jan. 31, 1979

[51] Int. Cl.[2] ..... B65D 85/22

[52] U.S. Cl. ..... 221/206; 221/312 R; 206/443; 312/73

[58] Field of Search ..... 221/188, 190, 206, 303, 221/312 R; 222/545, 546, 543, 547; 206/443, 380, 381, 379, 371; 220/375, 254; 312/73

[56] References Cited

U.S. PATENT DOCUMENTS

| | | | |
|---|---|---|---|
| 1,080,248 | 12/1913 | Bell | 221/312 R |
| 1,648,448 | 11/1927 | Derrick | 206/380 X |
| 2,193,732 | 3/1940 | Luber | 221/312 R |
| 2,843,292 | 7/1958 | Baehr | 221/197 X |
| 2,874,882 | 2/1959 | Sethne et al. | 222/543 |
| 2,962,185 | 11/1960 | Starr et al. | 220/254 |
| 3,212,670 | 10/1965 | Tiut et al. | 221/312 R |
| 3,815,734 | 6/1974 | Kruckel | 206/443 |
| 4,127,219 | 11/1978 | Mabus | 221/303 |

FOREIGN PATENT DOCUMENTS

| | | | |
|---|---|---|---|
| 942706 | 2/1964 | Canada | 206/12 |
| 1153454 | 3/1958 | France | 206/380 |
| 163053 | 7/1933 | Switzerland | 221/312 |
| 265155 | 11/1949 | Switzerland | 221/312 R |

*Primary Examiner*—Allen N. Knowles

[57] ABSTRACT

A dispenser for delivering any one of three different quantities of uncooked spaghetti or the like elongated rod-like pasta elements. The dispenser consists of an elongated container with a removable lid having a central round opening and a series of rings of progressively decreasing diameter removably fitted within said round opening and within one another. A closing cap is removably fitted within the ring of smallest diameter. The rings may be selectively open for choosing the size of the opening required for the metering of the required portion of pasta. The pasta is discharged by turning the container upside down. When the cap is in closed position, the pasta is stored in the container in a hygienic manner. The lid is of arcuate shape to facilitate delivering of pasta.

4 Claims, 3 Drawing Figures

PASTA DISPENSER

The present invention relates to a container means for containing and dispensing a measured amount of food and, more particularly, uncooked spaghetti and other similar uncooked pasta made of rigid elongated rod-like elements.

Uncooked pasta, such as spaghetti, is usually sold in elongated cardboard boxes. It is difficult to measure the right amount of spaghetti to be cooked in accordance with the number of persons to be served, because spaghetti swells during cooking. Also, it is not very hygienic to store the pasta in an opened cardboard box.

It is therefore the general object of the present invention to provide a container for storing pasta in hygienic condition and which serves for dispensing a measured amount of pasta.

Another object of the present invention is to provide a container of the character described having a special spout in corporating means to select the size of the dispensing opeining so that different amounts of pasta can be measured and delivered.

In accordance with the invention, a container cylindrical in shape and long enough to store uncooked pasta under the form of rod-like elements, includes a snap-on lid at its upper end. The lid has a central discharging round opening and rings of successively decreasing diameter and removably fitted within said round opening and within each other. One or more of the rings can be removed to select the size of the discharge opening for the delivery of a selected amount of pasta upon turning the container upside down.

A cap is removably fitted within the smallest diameter ring to store the pasta in hygienic manner within the container. The lid is preferably convex to facilitate discharge of the pasta.

The above will be more clearly uderstood by reference to the following detailed description and to the accompanying drawings illustrating a preferred embodiment of the invention and in which.

In the drawings, like reference characters indicate like elements throughout.

Figure 1:
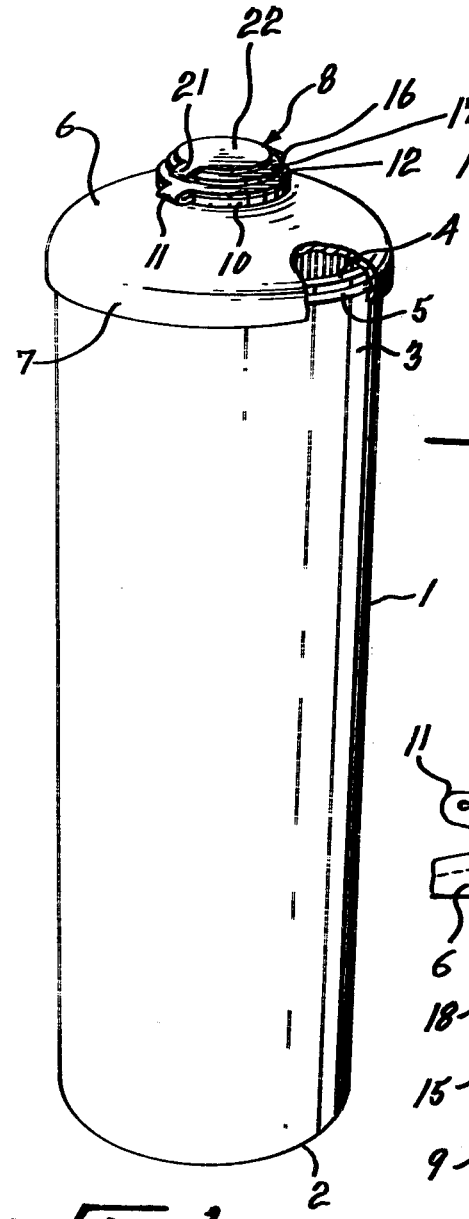
FIG. 1 is a perspective view of the container with the snap-on lid partially cut away and showing the closure means in closed position.

A container means 1 is generally cylindrical in shape and includes a bottom 2 and an upper end 3 provided with a full size aperture 4. Just below the edge of aperture 4, is a circumferential rib 5 provided for the locking fit of a snap-on lid 6. Snap-on lid 6 has a concave internal face and a circumferential downwardly projecting flange 7 provided with a groove at its inner face to receive rib 5 for retaining the lid on the container.

Figure 2:
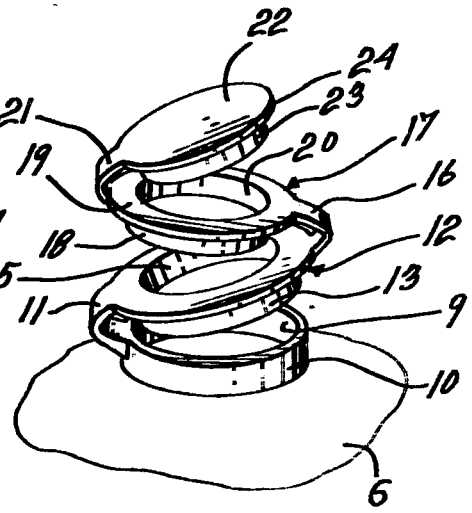
FIG. 2 is a perspective view of the closure means carried by the lid and shown partially open.

The top central portion of snap-on lid 6 is provided with closure means 8, as clearly shown in FIG. 2.

Lid 6 is provided with a central round opening 9 which is circumferentially bordered by an upstanding cylindrical flange 10. Closure means 8 comprise a detachable ring 12 integrally connected to flange 10 by a flexible tab 11. Ring 12 consists of a vertical rim 13 removably fitting within round opening 9 and further consisting of a circumferential and outwardly extending annular flange 14 adapted to overlie flange 10.

Figure 3:
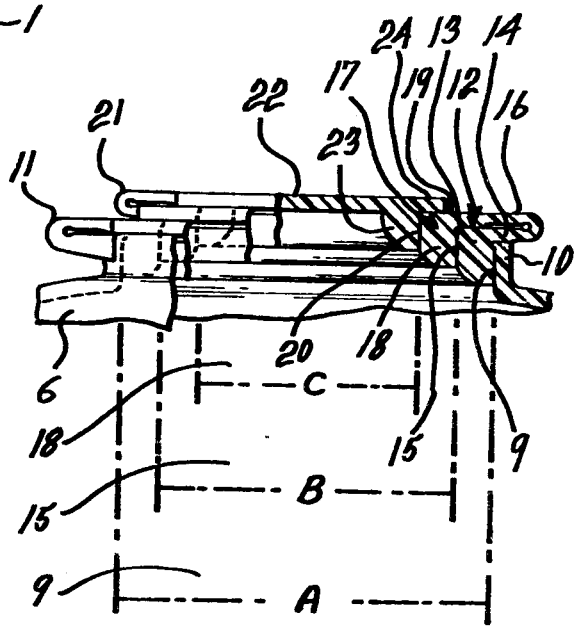
FIG. 3 is a side view, partially sectioned, of the closure means in fully closed position.

The round opening 15 defined by detachable ring 12 is slightly smaller than round opening 9, as clearly shown by the dash lines and letters A and B in FIG. 3.

Diametrically opposite tab 11 is flexible tab 16 projecting outwardly from flange 14 of ring 12. Tab 16 attaches to a detachable ring 17 which is identical to the detachable ring 12, except that it is smaller in diameter. Ring 17 has a rim 18 which fits into round opening 15 and an annular flange 19 which overlies rim 13. Detachable ring 17 forms a round opening 20 smaller than openings 9 and 15, as indicated by the dash line and letter C in FIG. 3.

Diametrically opposite tab 16 is flexible tab 21 attaching ring 17 to a top closing cap 22, which is flat on top and has a downwardly projecting rim 23 and a circumferential outwardly projecting flange 24. Rim 23 fits into opening 20 and flange 24 overlies rim 18.

As is readily perceivable, rings 12 and 17 can be selectively open and closed one at the time, or all together, such that the container has a handy measuring means for dispensing three different amounts of pasta to be delivered from the container when the latter is turned upside down.

When the container is used simply to store the pasta, sealing cap 22 shuts tightly to preserve the pasta in hygienic manner.

Thus, the invention permits the easy metering of large, medium or small amounts of pasta by simply opening the appropriate ring, while leaving the others closed and pouring the container 1. Evidently, the pasta is kept in upright and unbroken condition in container 1.

The concave inner shape of lid 6 facilitates guiding of the pasta towards the central opening when delivering the pasta.

The container, the lid and the closure means are preferably made of a synthetic resin.

I claim:

1. A pasta dispenser comprising an elongated container provided with a bottom and having a topmost full size aperture, a removable lid for closing said aperture, said lid being provided with a central round pasta discharging opening, and a ring removably fitted within said last-named opening and defining a second round pasta discharging opening of smaller diameter than said first-named opening for the selective delivery of two different amounts of pasts, depending on whether the first or second opening is used, when the container is turned upside down.

2. A pasta dispenser as claimed in claim 1, further including a cap removably fitted within said ring to close both discharge openings.

3. A pasta dispenser as claimed in claim 2, wherein flexible tabs integrally connect said cap to said ring and said ring to said lid, respectively.

4. A pasta dispenser as claimed in claim 1 or 2, wherein said lid has an inner concave shaped surface.

* * * * *